US006767014B2

(12) United States Patent
Dolin

(10) Patent No.: US 6,767,014 B2
(45) Date of Patent: Jul. 27, 2004

(54) PUZZLE COVER

(76) Inventor: Jennifer Lynn Rooks Dolin, P.O. Box 534, 11117 Kenilworth Ave., Garrett Park, MD (US) 20896

( * ) Notice: Subject to any disclaimer, the term of this patent is extended or adjusted under 35 U.S.C. 154(b) by 0 days.

(21) Appl. No.: 10/246,143

(22) Filed: Sep. 17, 2002

(65) Prior Publication Data

US 2003/0057646 A1 Mar. 27, 2003

Related U.S. Application Data

(60) Provisional application No. 60/324,335, filed on Sep. 24, 2001.

(51) Int. Cl.[7] ..... A63F 9/10
(52) U.S. Cl. ..... 273/157 R
(58) Field of Search ..... 273/153 R, 157 R; 206/315.1, 579; 2/68, 174

(56) References Cited

U.S. PATENT DOCUMENTS 2,427,318 A * 9/1947 Warren ..... 273/157 R
3,051,960 A * 9/1962 Rendulich ..... 2/68
3,504,915 A * 4/1970 Walker ..... 273/157 R
3,550,945 A * 12/1970 Resnick ..... 273/157 R
3,677,399 A * 7/1972 Tatar ..... 273/157 R
4,484,745 A * 11/1984 Sleeper ..... 273/157 R
4,612,220 A * 9/1986 Baxter ..... 273/157 R
4,811,951 A * 3/1989 Dorsey-Zinn et al. .. 273/157 R
5,484,638 A * 1/1996 Crabtree ..... 428/67
5,685,018 A * 11/1997 West ..... 2/174
6,364,116 B1 * 4/2002 Ng ..... 273/157 R

* cited by examiner

*Primary Examiner*—Steven Wong
(74) *Attorney, Agent, or Firm*—Sutherland Asbill Brennan LLP

(57) ABSTRACT

A puzzle maintenance system. The maintenance system includes a puzzle board with a number of shaped puzzle pieces positioned on a first side thereof and a fitted cover positioned at least about the first side so as to keep the puzzle pieces in place.

7 Claims, 6 Drawing Sheets

PUZZLE COVER

RELATED APPLICATIONS

The present invention claims priority to U.S. Provisional application Ser. No. 60/324,335, filed on Sep. 24, 2001.

TECHNICAL FIELD

The present invention relates generally to a removable cover and more particularly relates to a cover for a child's puzzle board or other article.

BACKGROUND OF THE INVENTION

A popular activity for children is to play with puzzles. For younger children, the puzzles may include a puzzle board with cutouts of different shapes. One problem with such boards, however, is that the pieces often fall off of the board and may be difficult to find and replace. Further, putting the puzzles away often includes completing a pile of puzzles. Parents may not be inclined to travel with these puzzles because of the fact that the pieces may be easily lost.

There are approximately 9 million children's cardboard and wooden puzzles sold in the U.S. each year, suitable for age 18 months and older. They may range in price from relatively inexpensive (about $1 for thin cardboard) to moderate ($20 for large wooden board puzzles with wooden pieces) or more. An average, small wooden puzzle of about six (6) to eight (8) pieces may cost about $10.

Most puzzles generally have flat pieces, raised pieces, and/or pieces with wooden or plastic pegs. There also are some puzzles that have magnetic boards with magnetic pieces or felt boards with felt pieces. Other types of puzzle pieces may be triangular, rectangular, or any other irregular shape. Most of the wooden or thick cardboard puzzles are sold shrink-wrapped, with no storage case. Once opened, the pieces may separate from the boards and become lost. Several puzzle manufacturers acknowledge this problem by providing free replacement pieces.

There is a desire therefore, for a lightweight, inexpensive product that can keep puzzles together when children are finished playing with them. This product should be easy to use for either adults or children.

SUMMARY OF THE INVENTION

The present invention thus provides a puzzle maintenance system. The puzzle maintenance system may include a puzzle board and an elastic cover. The puzzle board may include a plurality of puzzle pieces positioned on a first side. The elastic cover may be removeably positioned at least about the first side of the puzzle board so as to keep the plurality of puzzle pieces about the first side of the puzzle board.

Specific embodiments of the present invention may include an elastic cover made of a fabric, polymer, or elasticized material and be made at a predetermined size. The elastic cover also may include a window. The window may be made of a substantially transparent material. The elastic cover also may include a pocket with an outer rim and an elastic cord positioned within the outer rim.

The present invention also provides a device for maintaining a plurality of puzzle pieces about a puzzle board. The device may include a cover made of a predetermined size and an elastic material. The device also may include a securing means associated with the cover so as to conform the cover to the puzzle board.

Specific embodiments of the device may include an elastic cover made of a fabric, polymer, or elasticized material. The cover also may include a window. The window may be made of a substantially transparent material. The cover may include a pocket with an outer rim and an elastic cord positioned within the outer rim.

The present invention also provides a method for maintaining a plurality of puzzle pieces in predetermined locations on a puzzle board. The method may include the steps of selecting an elastic cover element of a predetermined size, placing each of the plurality of puzzle pieces in a corresponding one of the predetermined locations, and covering the puzzle board with the cover element so as to keep the plurality of puzzle pieces in place.

DETAILED DESCRIPTION

Figure 1:
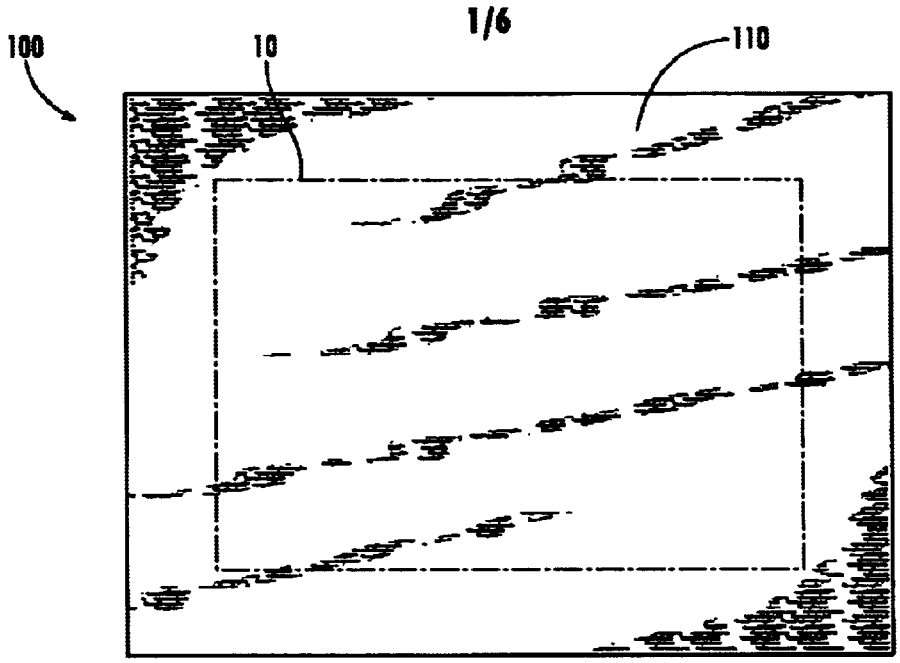
FIG. 1 is a plan view of a pre-cut sheet used for the present invention with measurement lines thereon.

Referring now to the figures, in which like numerals refer to like parts throughout the views, FIGS. 1–6 show a puzzle cover 100 of the present invention. The puzzle cover 100 may be used with a puzzle board 10 with a number of puzzle pieces 20. Any conventional puzzle board 10 may be used. The puzzle pieces 20 may have any shape or size.

The cover 100 may fit over the puzzle board 10 with the puzzle pieces 20 thereon. The cover 100 prevents the pieces 20 from moving, dislodging, or detaching from the board 10. The cover 100 may be made out of one or more pieces of material. The cover 100 may use any type of fabric, material, mesh, polymer, elastic, or a combination of any of these materials or fabrics. In this example, the cover 100 may be a single piece of heavy elasticized material. Specifically, the cover may be a four-way elasticized material. The cover 100 may be made from material in several bright colors (red, blue, and purple) that provide a smooth, flat texture. The cover 100 may be made with multiple colors and patterns. The material may be washable and/or water and stain resistant.

The puzzle cover 100 may include a top side 110 and a bottom side 120. The bottom side 120 may define a pocket 130 with an outer rim 140. The outer rim 140 may include a cord 150 of elastic material. Alternatively, the outer rim 140 may have one or more elastic bands or cords that fit around any or all of the edges of the board 10 so as to secure the pieces to the board 10. The cover 100 also may include a web of elastic bands that secures the pieces 20 in place.

The cover 100 also may include a non-elastic cord with a securing device to keep the cord taut. The securing device may include a tying mechanism, a locking mechanism, or any other mechanism known in the art to secure a non-elastic cord at a desired position.

As is shown in FIG. 1, the cover 100 may be made by measuring the flat dimensions of the typical children's puzzle board 10 (height and length) and then cutting a sheet 160 of material about two (2") inches larger on each side. It is understood that the dimensions used herein are for the purpose of example only. Any convenient dimensions may be used. The cover 100 may be made inside out, i.e., the side of the sheet 160 facing up will be the exterior side that is visible once the cover 100 is completed.

Figure 2:
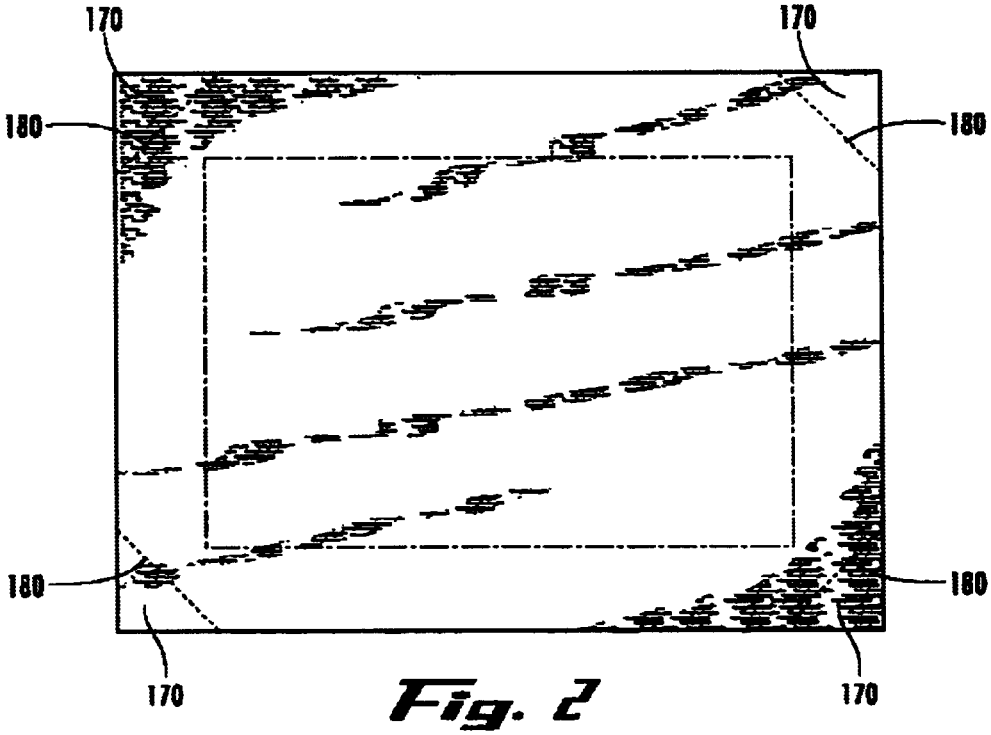
FIG. 2 is a plan view of the sheet of FIG. 1 showing cut line markings on the corners of the sheet.
Figure 3:
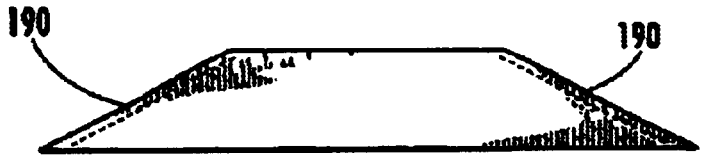
FIG. 3 is a side plan view of the sheet of FIG. 1 with the corners of the sheet cut, gathered, and sewn together.
Figure 4:
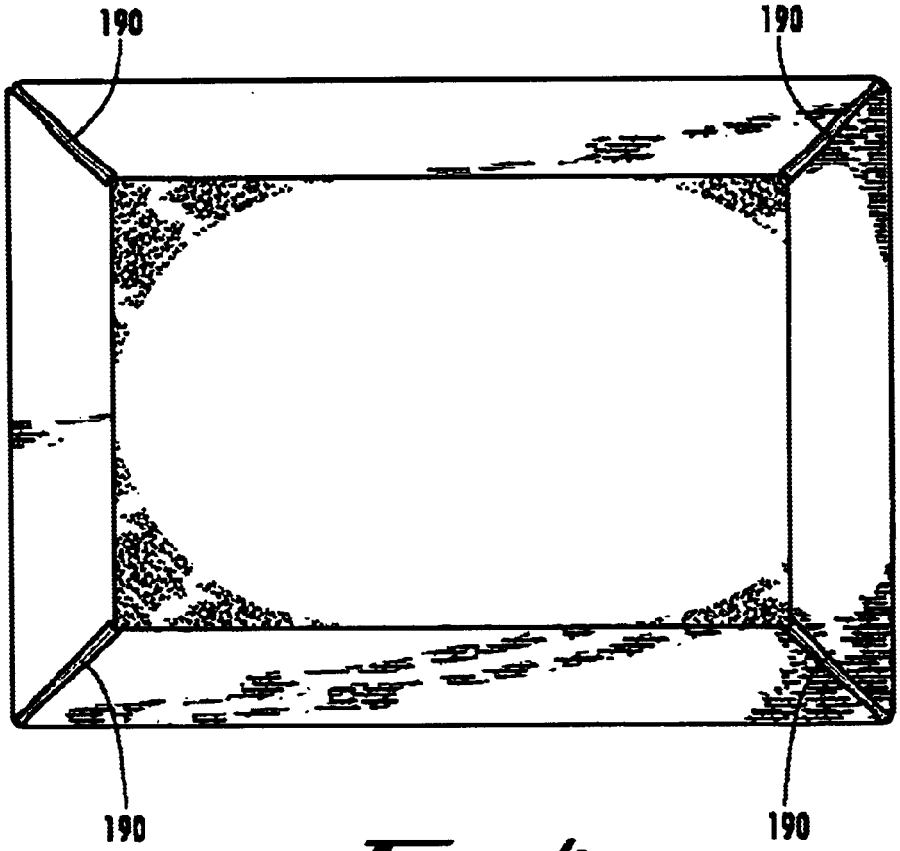
FIG. 4 is a top plan view of the sheet of FIG. 1 with the corners of the sheet cut, gathered, and sewn together.

As is shown in FIG. 2, each of the corners 170 of the sheet may be cropped by measuring about three and one half inches (3½") horizontally and vertically from each corner 170. A cut 180 then may be made by connecting these measurements, thus creating a triangular cut that measures about three and one half inches (3½") on the horizontal edge, about three and one half inches (3½") on the vertical edge, and about five inches (5") on the hypotenuse. As described above, these dimensions may vary with the size of the puzzle board 10. As is shown in FIGS. 3 and 4, the edges of the crop at each corner 170 may be matched together and sewn to form a seam 190 of about a quarter inch (¼"). The piece 160 now forms a three-dimensional, (developed) open-faced box. The cover 100 may be similar in look to a fitted sheet.

Figure 5:
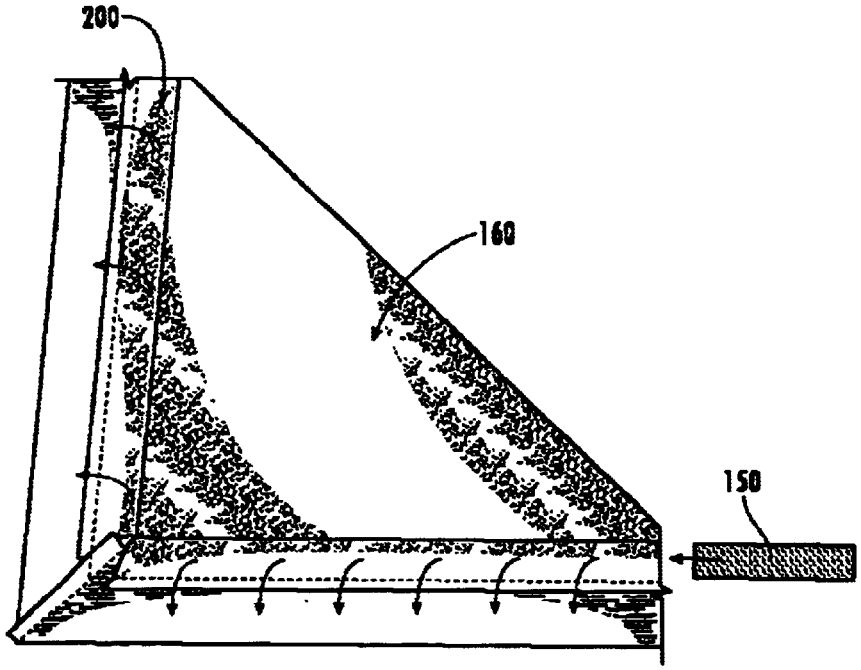
FIG. 5 is a plan view of a corner of the sheet of FIG. 1 with the edges folded over, sewn, and the elastic cord inserted therein.
Figure 6:
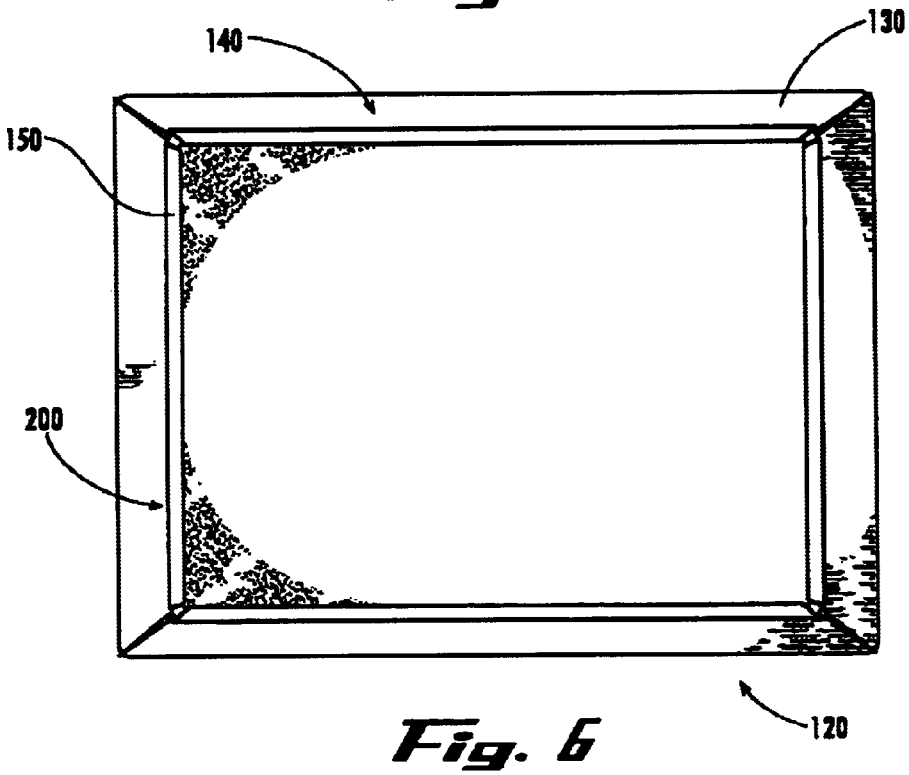
FIG. 6 is a bottom plan view of the sheet of FIG. 1 finished into the cover 100.
Figure 7:
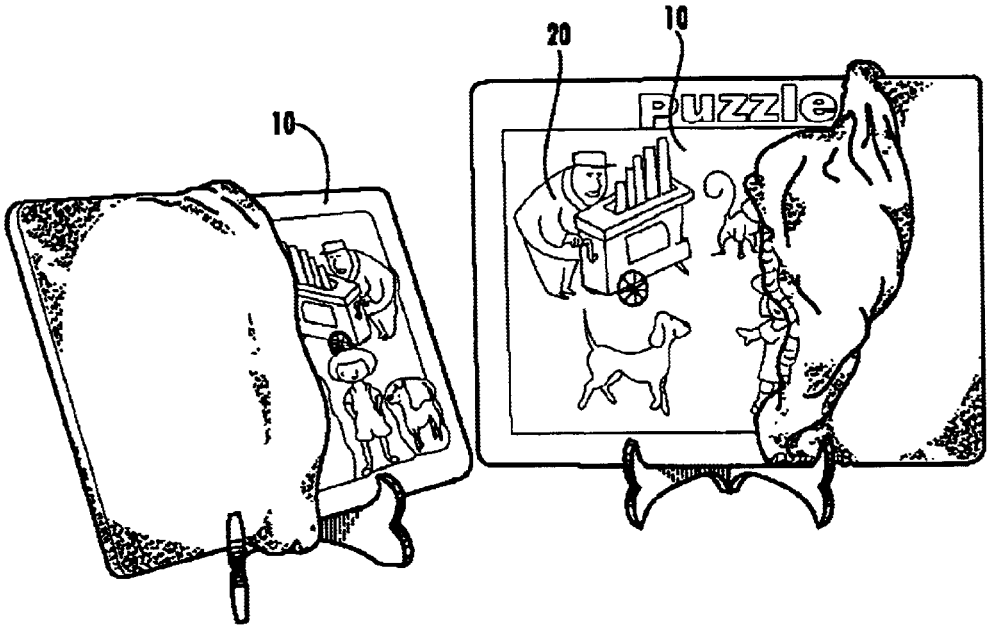
FIG. 7 is a perspective view of the cover 100 of the present invention partially positioned on a puzzle board.
Figure 8:
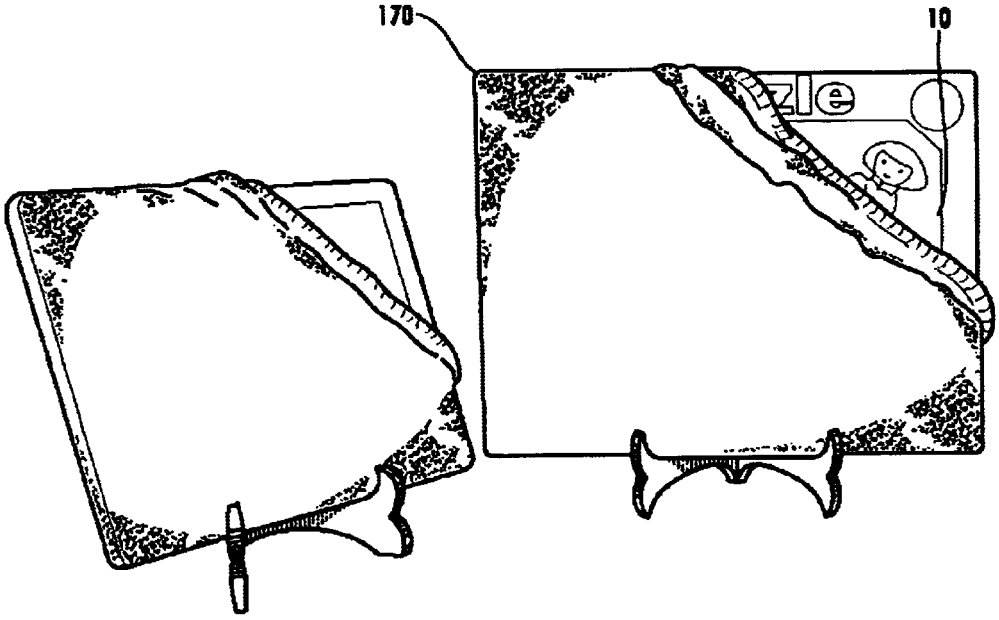
FIG. 8 is a perspective view of the cover 100 of the present invention partially surrounding a puzzle board.
Figure 9:
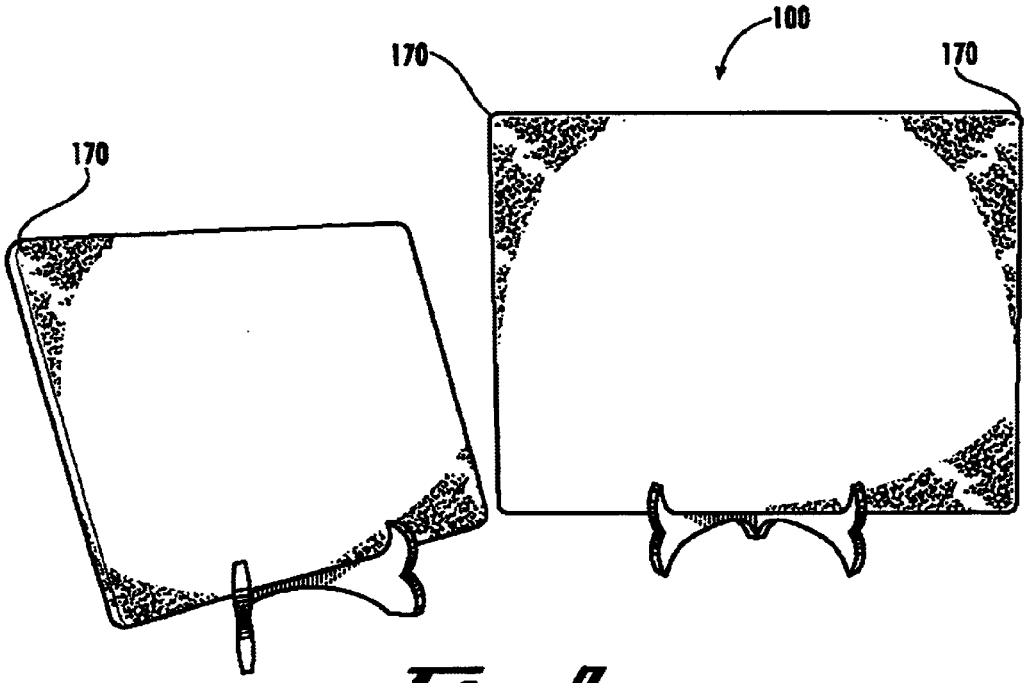
FIG. 9 is a perspective view of the top of the cover 100 surrounding a puzzle board.
Figure 10:
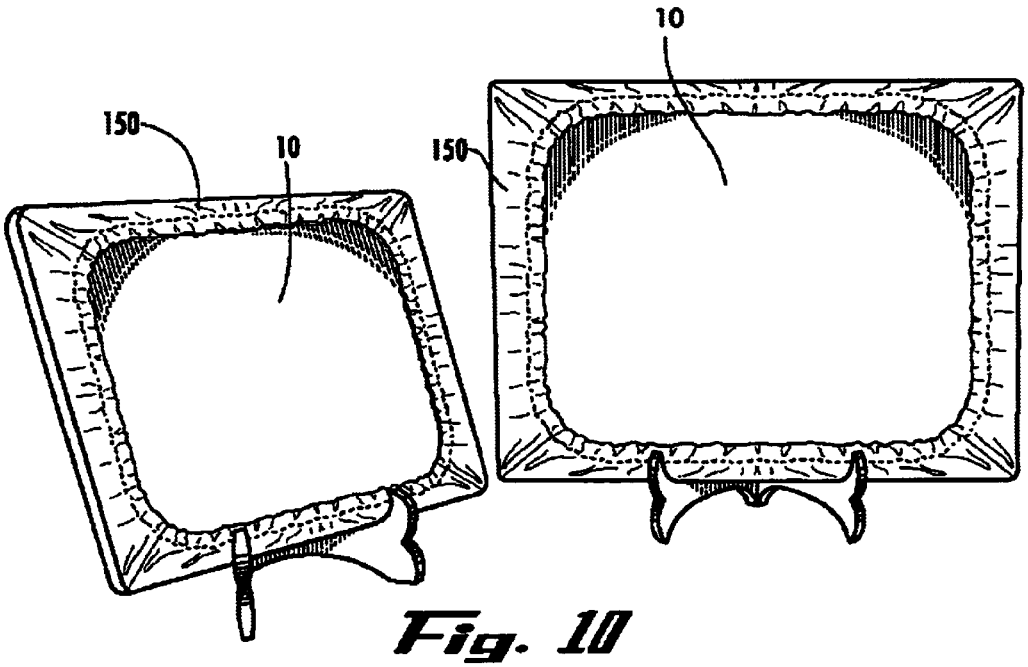
FIG. 10 is a perspective view of the bottom of the cover 100 surrounding a puzzle board.

As is shown in FIG. 5, the edges of the entire sheet 160 may be folded over backward away from the upward-facing material (towards the interior side of the material) to form a fold 200 of about one inch (1") in length. A piece of the elastic cord 150 may be secured into the fold 200 by sewing one end of the elastic cord 150 onto the material and running the length of the elastic cord 150 through the fold 200 as the fold 200 is being sewn. The fold 200 creates a pocket for the elastic cord 150. The second end of the elastic cord 150 may be sewn to the material and the pocket may be sewn shut so as to completely encase the elastic cord 150. The elastic cord 150 also may be sewn directly onto the material at any plurality of locations along the elastic cord 150.

As is shown in FIGS. 7–10, the sheet 160 may now be turned right-side in and slipped over the front of the puzzle board 10 and secured by slipping it over each of the four corners of the board 10. The sewn corners 170 of the cover 100 fit snugly over the corners of the board 10 so as to wrap around the flat surface and "hug" the bottom side of the board 10. The elastic cord 150 pulls on the material slightly and keeps it taut to prevent the pieces 20—either flat, raised, or with knobs—from slipping or detaching from the base 10. The entire puzzle 10, 20, 100 can be carried or stored horizontally or vertically.

By way of example, the cover 100 may be approximately 8¾ inches by 11¾ inches so as to fit most small wooden puzzles within an inch of these dimensions. Alternatively, the cover 100 may be about eleven (11) inches by about fourteen (14) so as to fit the larger puzzles on the market or three small puzzles stacked on top of each other. Either size can hold multiple cardboard and wooden puzzles 20 stacked on top of each other, depending upon the thickness of the puzzles. Smaller, non-uniform puzzles can be held in place securely when placed on top of a "standard" size, thin puzzle and secured by a cover 100. Further designs may include specialty shapes and sizes to fit, for example, triangular puzzles, etc. It is important to note that the dimensions listed herein are for example only. The actual dimensions may vary.

The cover 100 also may be used to hold felt boards 10 and their multiple pieces 20. Felt boards 10 may be similar in size to traditional puzzles and may have similar needs due to the many felt pieces 20 that can be used. The cover 100 also may be used with any other item or product that includes a similar-sized flat board 10 and additional components that the user would like to keep together.

Figure 11:
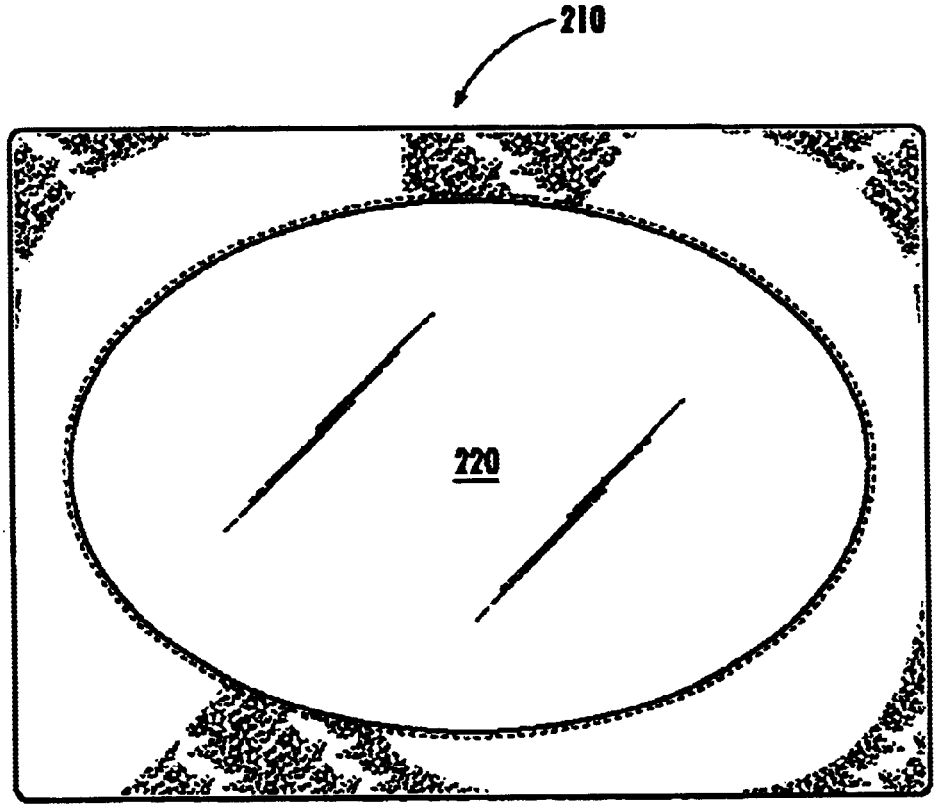
FIG. 11 is a plan view of an alternative embodiment of the present invention.

FIG. 11 shows an alternative embodiment of the present invention. A cover 210 may include a window 220 so as to allow the user to identify the puzzle board 10 secured by the cover 210. The window 220 may be created by removing an area of any size and shape from the cover 210 and by sewing a section of mesh material, clear material, or other substantially transparent material to the cover to fill the area that has been removed. The window 220 may not be used if the cover is sufficiently transparent to allow the user to identify the puzzle or if identification of the puzzle board 10 is not desired.

It should be apparent that the foregoing relates only to the preferred embodiments of the present invention and that numerous changes and modifications may be made herein without departing from the spirit and scope of the invention as defined by the following claims.

I claim:

1. A puzzle maintenance system, comprising:

a puzzle board comprising a plurality of edges;

said puzzle board comprising a plurality of puzzle pieces positioned on a first side thereof; and a removable cover comprising an elastic cord positioned in an outer portion of said cover, wherein said cover completely encloses said first side of said puzzle board and said plurality of edges of said puzzle board and secures said plurality of puzzle pieces about said first side of said puzzle board with said elastic cord.

2. The system of claim 1, wherein said cover comprises an elastic material.

3. The system of claim 1, wherein said cover is selected from a group consisting of fabric and polymer.

4. The system of claim 1, wherein said cover comprises a window.

5. The system of claim 4, wherein said window comprises a substantially transparent material.

6. The system of claim 1, wherein said cover comprises a predetermined size.

7. A method for maintaining a plurality of puzzle pieces in predetermined locations on a puzzle board comprising a plurality of edges, said method comprising the steps of:

selecting a cover element of a predetermined size comprising an elastic cord positioned in an outer portion of said cover;

placing each of said plurality of puzzle pieces in a corresponding one of said predetermined locations;

covering said puzzle board with said cover element so as to keep said plurality of puzzle pieces in place; and wrapping said cover completely around said plurality of edges of said puzzle board, wherein said elastic cord secures said cover to said puzzle board.

* * * * *